United States Patent [19]

Kuwata et al.

[11] Patent Number: 4,847,609

[45] Date of Patent: Jul. 11, 1989

[54] ELECTROLUMINESCENCE DISPLAY PANEL CONFIGURED FOR MINIMIZED POWER CONSUMPTION

[75] Inventors: Jun Kuwata, Osaka; Yosuke Fujita, Kobe; Takao Tohda, Ikoma; Masahiro Nishikawa, Amagasaki; Tomizo Matsuoka, Osaka; Atsushi Abe, Ikoma, all of Japan

[73] Assignee: Matsushita Electric Industrial Co., Ltd., Osaka, Japan

[21] Appl. No.: 101,313

[22] Filed: Sep. 24, 1987

[30] Foreign Application Priority Data

Sep. 26, 1986 [JP] Japan ..... 61-228985

[51] Int. Cl.[4] ..... G09G 3/30

[52] U.S. Cl. ..... 340/781; 340/771; 315/169.3

[58] Field of Search ..... 340/781, 766, 771, 772, 340/805, 811, 812; 350/331 R, 333, 334, 336; 315/169.3, 169.4

[56] References Cited

U.S. PATENT DOCUMENTS

| | | | |
|---|---|---|---|
| 3,641,533 | 2/1972 | Sylvander | 340/781 |
| 4,152,626 | 5/1979 | Hatta et al. | 340/781 |
| 4,456,909 | 6/1984 | Takahara et al. | 340/781 |
| 4,479,120 | 10/1984 | Ohuba et al. | 340/781 |
| 4,594,589 | 6/1986 | Ohuba et al. | 340/781 |

*Primary Examiner*—David K. Moore
*Assistant Examiner*—M. Fatahiyar
*Attorney, Agent, or Firm*—Pollock, Vande Sande & Priddy

[57] ABSTRACT

An electroluminescent display panel formed of phosphor and dielectric layers sandwiched between opposing mutually intersecting arrays of drive electrodes, has the thickness of the phosphor layer set to a value which provides minimum power consumption, for a given level of display brightness. This is achieved by determining a value of capacitance per unit area of the panel which results in a maximum allowable value of time being required to charge each display element, then determining a value of phosphor layer thickness providing minimum power consumption, using the latter value of capacitance and the known value of light emission efficiency of the display.

2 Claims, 13 Drawing Sheets

ELECTROLUMINESCENCE DISPLAY PANEL CONFIGURED FOR MINIMIZED POWER CONSUMPTION

BACKGROUND OF THE INVENTION

The present invention relates to an electroluminescence (hereinafter abbreviated to EL) display panel having a layer-built structure containing phosphor and dielectric layers, and in particular to an EL display panel having a structure which is optimized to provide high display brightness with low power consumption, and is suited for use as a flat panel display having a high degree of resolution, for office automation equipment, computer terminals, etc.

An EL display panel emits light in response to an applied AC electric field, and is made up of a phosphor layer having a dielectric layer formed on one or on both sides thereof, with the layered structure thereby formed being sandwiched between an array of elongated mutually intersecting data electrodes and scanning electrodes, to thereby define an array of display elements. With one method of driving such a display panel (referred to in the following as the field-refresh drive method), periodically repetitive scanning drive of these electrodes is executed such that a voltage $V_{ON}(=V_H+\Delta V$ or higher) is applied once in each scanning (field) interval to each display element which is to be selected (i.e. is to be set in the light-emitting state), and a voltage $V_{OFF}$ $(=V_H-\Delta V$ or less) is applied to each non-selected display element (i.e. which is to be left in the non-emitting state). Upon completion of scanning of the entire display, a refresh pulse $V_R$ having a polarity that is opposite to that of the voltage $(V_H+\Delta V)$ is applied to all of the display elements, to thereby provide AC drive operation. Voltage $V_H$ is a threshold voltage level, at which emission of light begins, while $\Delta V$ is a modulation voltage which serves to determine the elements which are selected and non-selected, i.e. the elements which emit light and the elements which do not. With this drive method, each time a scanning electrode is selected during the sequential scanning, the address data for the data electrodes are updated and a data pulse is generated.

The electrical power which is required to drive such an EL display panel consists of a modulation drive component, a component corresponding to the threshold voltage $V_H$ required to initiate the emission of light, and a component corresponding to the refresh voltage $V_R$. The actual values of the drive voltages $\Delta V$, $V_H$ and $V_R$ are determined by the light emission characteristics of the EL display panel.

FIG. 1 illustrates the relationship between emitted light brightness and applied voltage, for an EL display panel, and shows $V_H$, $\Delta V$, $V_R$ and examples of voltages $V_{ON}$ and $V_{OFF}$ respectively utilized for selection and non-selection of display elements. Generally speaking, the values of $V_{ON}$ and $V_{OFF}$ are determined by the brightness or luminance of the display and the uniformity of that display brightness. These depend upon the thickness and the quality of the data electrode and the phosphor layer of the EL display panel. Ideally, the brightness of emission from a display element should rise sharply in response to variation of the voltage applied to that element (i.e. within the range $V_{OFF}$ to $V_{ON}$ shown in FIG. 1), in order to enable the value of $\Delta V$ to be made as small as possible. In the prior art, efforts to achieve this ideal form of operation have been directed mainly towards research into enhancement of the light-emission efficiency of the EL display panel. As an alternative approach to this problem, several drive methods have been proposed for such an EL display panel. However in order to optimize the operation of an EL display panel, i.e. to attain a high level of display brightness with minimum power consumption, it is necessary to consider both the configuration of the elements of the EL display panel, and the drive method. None of the EL display panels which are being marketed at the present time have been produced on the basis of such a design philosophy. As a result, such prior art EL display panels present severe problems with regard to excessive power consumption, if it is attempted to produce a large-scale high-definition display panel.

With regard to the power consumption in the case of the field-refresh drive method described above, since the display elements each have electrical capacitance, the power consumption can be computed as the amount of power which is required to execute charging and discharging of the capacitances of these elements. This power consumption will vary in accordance with the display pattern which is produced by the display. The display pattern which results in maximum power consumption will vary, depending upon the particular drive method which is utilized. In general, each of the data electrodes of the display panel is driven by a corresponding drive transistor, and in the case of the field-refresh drive method the maximum level of power consumption occurs when all of the data drive transistors act to discharge all of the display elements, after all of the display elements have been charged to the modulation voltage $\Delta V$. Designating this maximum value of power consumption under such a drive condition as $P_M$, then the value of $P_M$ for a thin-film EL display panel is given by the following equation, from the electrical capacitance $A \cdot C_T$ of the entire display area (where A is the display area and $C_T$ is the electrical capacitance of the display panel per unit of area), the voltages $\Delta V$, $V_H$ and $V_R$ which are applied during the drive process, the number of data electrodes M, the number of scanning electrodes N, the total stray capacitance $C_o$ of the drive lines (including the output capacitance of the drive transistors), and the field frequency F:

$$P_M = A \cdot F(2N \cdot C_T \cdot \Delta V^2 + C_t \cdot V_H^2 + C_T \cdot V_R^2) + N(M + N - 1) \cdot C_o \cdot F \cdot V_H^2 \quad (1)$$

The derivation of equation (1) is given by Yoshiharu Kanaya, Hiroshi Kishishita, and Jun Kawaguchi in "Nikkei Electronics" of 2nd Apr. 1979, in pages 118 to 142.

If the values of the drive voltages $\Delta V$, $V_H$ and $V_R$ are established in accordance with the light emission characteristic of the EL display panel and the electrical capacitance $A \cdot C_T$ of the entire display area and the display element configuration, then the power consumption can be immediately derived from equation (1) above, based on the size of the EL display panel, the numbers of scanning electrodes and data electrodes M and N, and the field frequency F (the latter being sometimes referred to as the frame frequency).

In the prior art, the display element configuration of an EL display panel has been determined by a process of trial and error, based upon a desired value of display brightness, the number of display elements of the display, the size of each display element, the power consumption, and limitations of drive voltage. As a result, it has not been possible in the prior art to minimize the power consumption of an EL display panel. Furthermore, as the size of the display area of such an EL display panel is increased, problems arise with regard to the necessity for reducing power consumption and for shortening the charging time of the display elements.

SUMMARY OF THE INVENTION

It is an objective of the present invention to overcome the problems of prior art EL display panels described above, by providing an EL display panel having a structure which provides high display brightness together with shorter charging time of the display elements and substantially lower power consumption than has been possible in the prior art.

To achieve the above objectives, an EL display panel according to the present invention is configured by establishing relationships between drive voltage and the amount of electrical charge which must be supplied to the display elements, and between drive voltage and the display brightness. These relationships are obtained as numerical expressions, derived from measured values. Using these expressions, the amount of charge which is necessary to produce a predetermined degree of display brightness and the amount of charge which must be supplied in order to initiate light emission by the phosphor layer are respectively computed, based upon the requisite size, number of display elements, and light emission efficiency $\eta$ of the phosphor layer of the display panel. The electrical capacitance of the entire display area is then obtained, based upon the number of scanning electrodes and data electrodes and the total display area, together with the respective values of electrical capacitance of the phosphor layer and the dielectric layer (which are variables). The value of the electrical capacitance per unit area $C_i$ of the dielectric layer which will make the time required to charge each display element of the display become less than the value [(frame frequency)$^{-1}\times$(number of scanning lines)$^{-1}$] is then determined, from an impedance value which is the sum of the electrode resistance and the drive system circuit impedance. Next, the power consumption P which occurs when the EL display panel is operating in a mode of maximum power consumption is expressed, as a relationship between $C_i$ and the thickness $d_z$ of the phosphor layer, and a value of $d_z$ is then selected which will provide a minimum value of the power consumption P, assuming $\eta$ and $C_i$ to be constant.

More specifically, an electroluminescent display panel according to the present invention comprises a phosphor layer having a predetermined thickness $d_z$ and a dielectric layer formed on at least one side of said phosphor layer and having a value of electrical capacitance $C_i$ per predetermined unit of area which is greater than a value of electrical capacitance $C_z$ per said unit of area of said phosphor layer, and two arrays of mutually intersecting stripe-configuration electrodes formed sandwiching said phosphor layer and dielectric layer for defining an array of display elements and for applying drive voltages to said display elements, each of said display elements having a fixed value of light emission efficiency $\eta$, at least one of said electrode arrays being transparent to light, the display panel being characterized in that, expressing a time T which is required to supply an amount of electric charge to each of said display elements, such as to produce a desired level of brightness of light emission from each said display element as a function $T(d_z, C_i, R, \eta)$ of said thickness $d_z$, said capacitance $C_i$, an impedance R constituted by values of resistance of said electrodes and of a drive circuit system coupled to drive said display panel, and said light emission efficiency $\eta$, the value of said capacitance $C_i$ is selected as a value $C_{io}$ which results in minimum allowable value for said time T, and in that, expressing a value of power consumption P of said display panel as a function $P(d_z, C_i, \eta)$ of said thickness $d_z$, said fixed value of light emission efficiency $\eta$ said capacitance $C_i$, the value of $d_z$ is selected to produce a minimum value of said power consumption P with said capacitance $C_i$ fixed at said value $C_{io}$.

The power consumption and the time required to charge each display element of an EL display panel having an arbitrary display size, number of picture elements, and light emission efficiency $\eta$ are respectively described by the thickness $d_z$ of the phosphor layer and the electrical capacitance $C_i$ of the dielectric layer. With the present invention, as described above, the value of $C_i$ is established such as to make the charging time become shorter than a maximum permissible pulse width which is determined by the field frequency, the number of scanning lines, and the drive equation which is utilized. With the value of $C_i$ thus fixed, the value of $d_z$ is then established such as to minimize the power consumption. In this way, for EL display panel having arbitrary light emission characteristic, optimum values for the thickness of the phosphor layer and for the electrical capacitance per unit area of the dielectric layer can be decided upon which will ensure minimum power consumption.

BRIEF DESCRIPTION OF THE DRAWINGS

FIG. 2(*b*) shows an equivalent circuit of the apparatus of FIG. 2(*a*);

FIGS. 5(*b*), 5(*c*) and 5(*d*) are graphs showing relationships between power consumption and values of $C_i$ and $d_z$;

FIG. 5(*e*) is a graph showing the relationship between optimum combinations of values of $C_i$ and $d_z$;

DESCRIPTION OF PREFERRED EMBODIMENTS

Figure 2A:
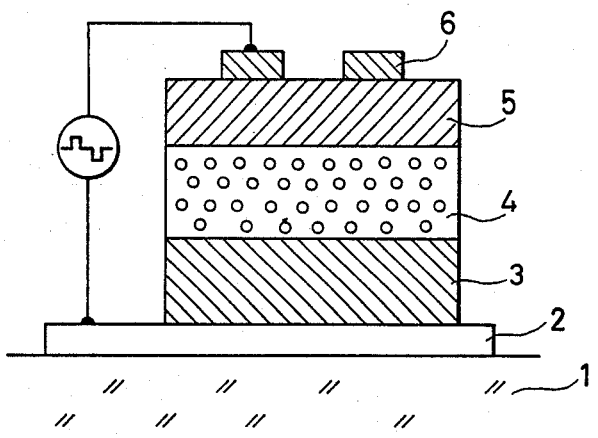
FIG. 2(*a*) is a cross-sectional view of an embodiment of an EL display panel according to the present invention.
Figure 2B:
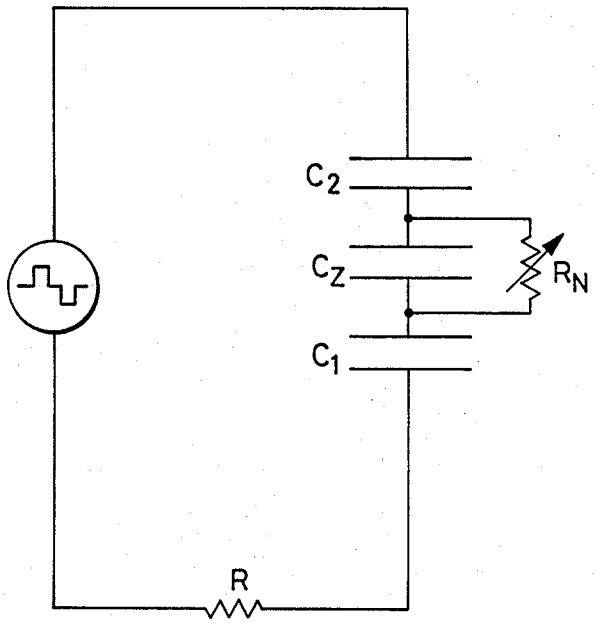

FIG. 2(*a*) shows an example of the basic configuration of a thin film EL display element. A stripe-shaped transparent electrode 2 is formed upon a glass substrate 1, and a first dielectric layer 3, a phosphor layer 4 and a second dielectric layer 5 are formed as successive layers upon the transparent electrode 2. A stripe-shaped rear electrode 6 is formed upon the layer 5, elongated in a direction which intersects that of the transparent electrode 2, to thereby form the display element. The electrical equivalent circuit of this element is shown in FIG. 2(*b*).

Considering the parameters of such an apparatus in terms of the value of each parameter per unit of area of the layers, the electrical capacitance of the first dielectric layer will be designated as $C_1$, that of the second dielectric layer as $C_2$, and that of the phosphor layer (when in a condition prior to emission of light) as $C_z$, each being as indicated in the equivalent circuit of FIG. 2(*b*). Before emission of light begins, the value of an equivalent parallel resistance $R_N$ (which shunts the capacitance $C_z$) is of sufficient magnitude that the phosphor layer 4 can be considered to be equivalent to a capacitance which is connected in series with the first and second dielectric layers. Hence, the electrical configuration of the element prior to the emission of light is equivalent to a combination of capacitors, with a combined capacitance $C_T$ which is expressed as:

$$C_T=(C_1^{-1}+C_2^{-1}+C_z^{-1})^{-1}.$$

For simplicity of description, the capacitances of the dielectric layers will be collectively designated as $C_i$, i.e.:

$$C_i=(C_1^{-1}+C_2^{-1})^{-1} \tag{2}$$

Thus:

$$C_T=(C_i^{-1}+C_z^{-1})^{-1}.$$

When the light-emitting condition is initiated, an avalanche phenomenon occurs within the phosphor layer, and hence that layer becomes electrically conductive so that the resistance $R_N$ becomes comparatively small, and the EL element becomes equivalent to a combination of capacitors having a total capacitance $C_i$. Designating the respective thicknesses of the dielectric layer and phosphor layer as $d_i$ and $d_z$, and their respective values of specific inductive capacity as $\epsilon_i$ and $\epsilon_z$, then the values of capacitance per unit area of the respective layers, i.e. $C_i$ and $C_z$, are given as follows:

$$C_i=(\epsilon_o\cdot\epsilon_i)/d_i \tag{2a}$$

$$C_z=(\epsilon_o\cdot\epsilon_z)/d_z \tag{2b}$$

In the above, $\epsilon_o$ is the dielectric constant of free space ( $=8.854\times10^{-12}$ F/m). In the case of ZnS being utilized, the value of $\epsilon_z$ is in the range 7.5 to 8. It will be assumed in the following that $\epsilon_z=8$.

The value of the threshold electric field strength $E_H$ at which the phosphor layer enters the avalanche state and emission of light begins, depends upon the thickness $d_z$ of the phosphor layer.

The following equation expressing a relationship between $E_H$ and $d_z$ has been obtained experimentally, from the results of measurements;

$$E_H(d_z)=\begin{cases} E_o\cdot d_z^{-a} & (d_z\leqq do) \\ E_o\cdot d_o^{-a} & (d_z\geqq do)\end{cases} \tag{3}$$

In the above, $E_o$, $d_o$ and a are constants, whose values are obtained by forming thin film EL elements with respectively different values of $d_z$, and measuring the values of $E_H$.

Figure 3:
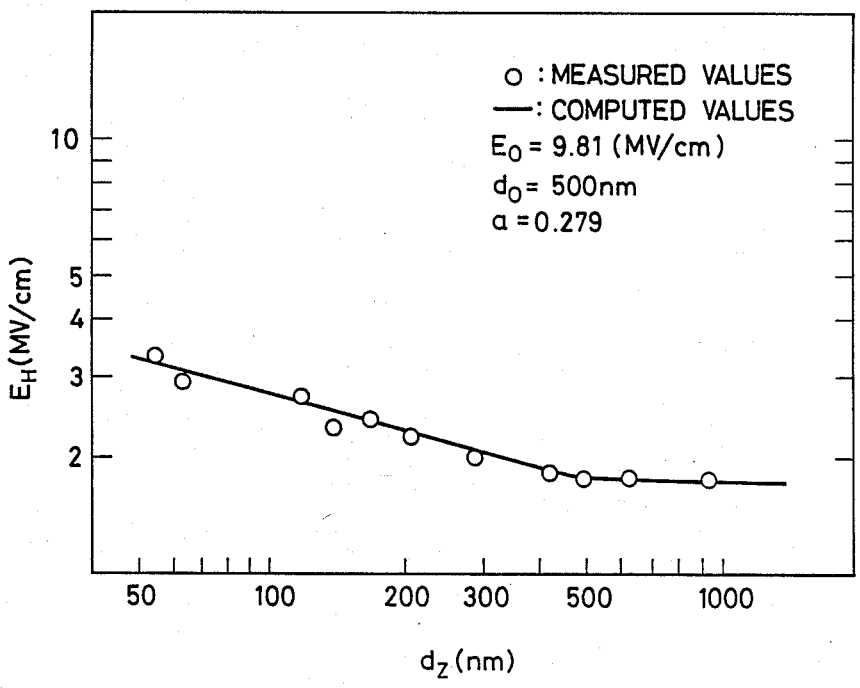
FIG. 3 is a graph showing the relationship between the thickness $d_z$ of a phosphor layer and a threshold electric field strength $E_H$.

FIG. 3 shows the relationship between $E_H$ and $d_z$

The relationship between the brightness L of a thin film EL display panel and the charge density $\Delta Q$ which arises within the phosphor layer during emission of light can be expressed as follows, as a formula obtained from the results of measurement:

$$L=L_o\cdot d_z\cdot F(1-\exp(-\Delta Q/\Delta Q_o)) \tag{4}$$

Figure 4:
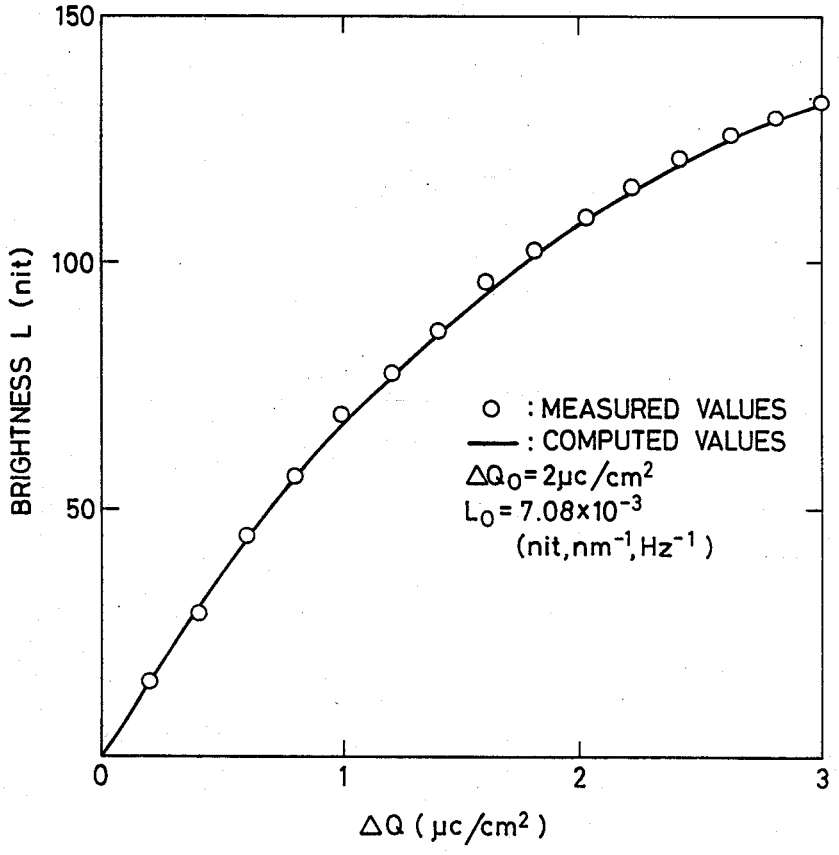
FIG. 4 is a graph showing the relationship between brightness L and charge density Q occurring in a phosphor layer during emission of light.
Figure 5A:
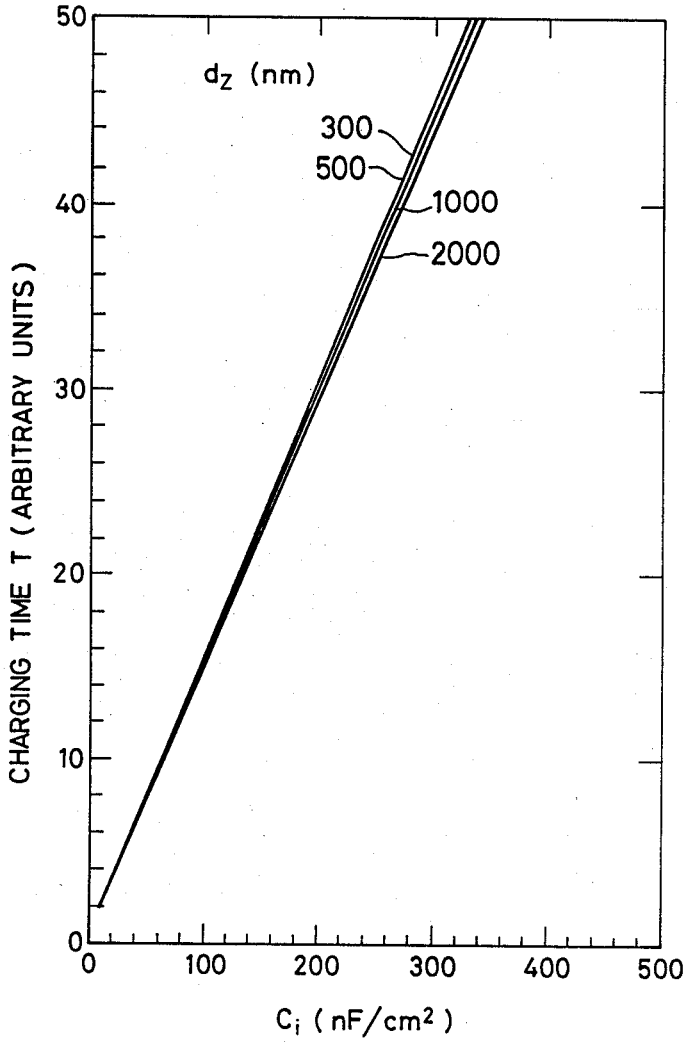
FIG. 5(*a*) is a graph showing the relationship between the electrical capacitance $C_i$ and the thickness $d_z$ of a phosphor layer, with respect to charging time T, for an embodiment of an EL display panel according to the present invention.
Figure 5B:
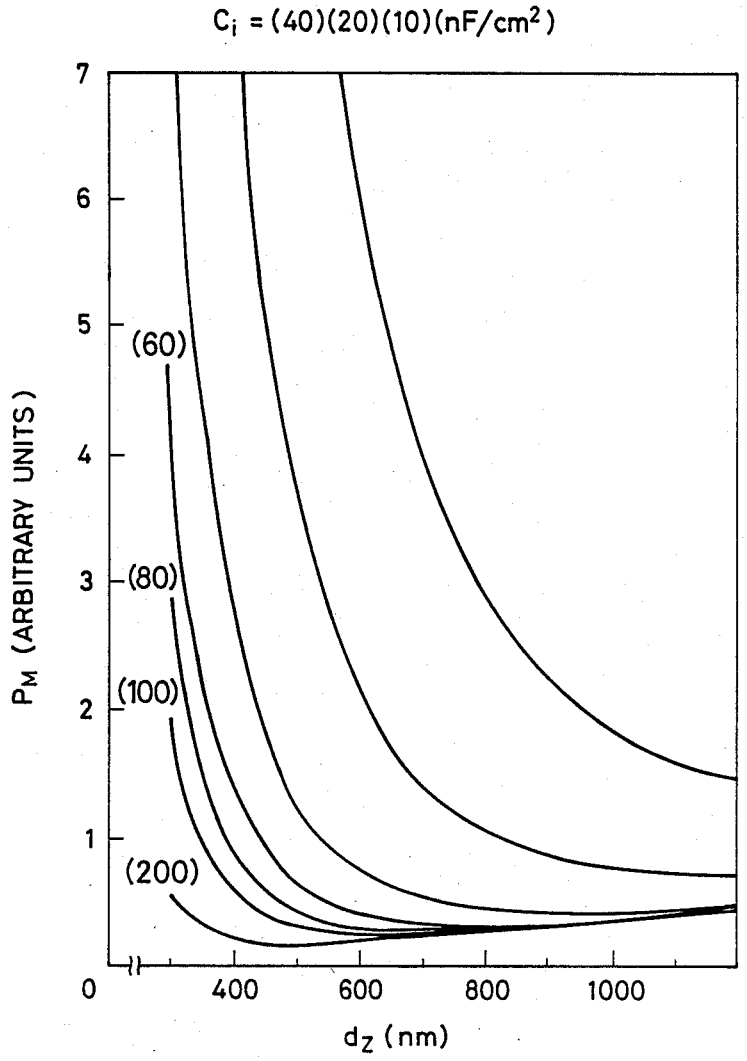
Figure 5C:
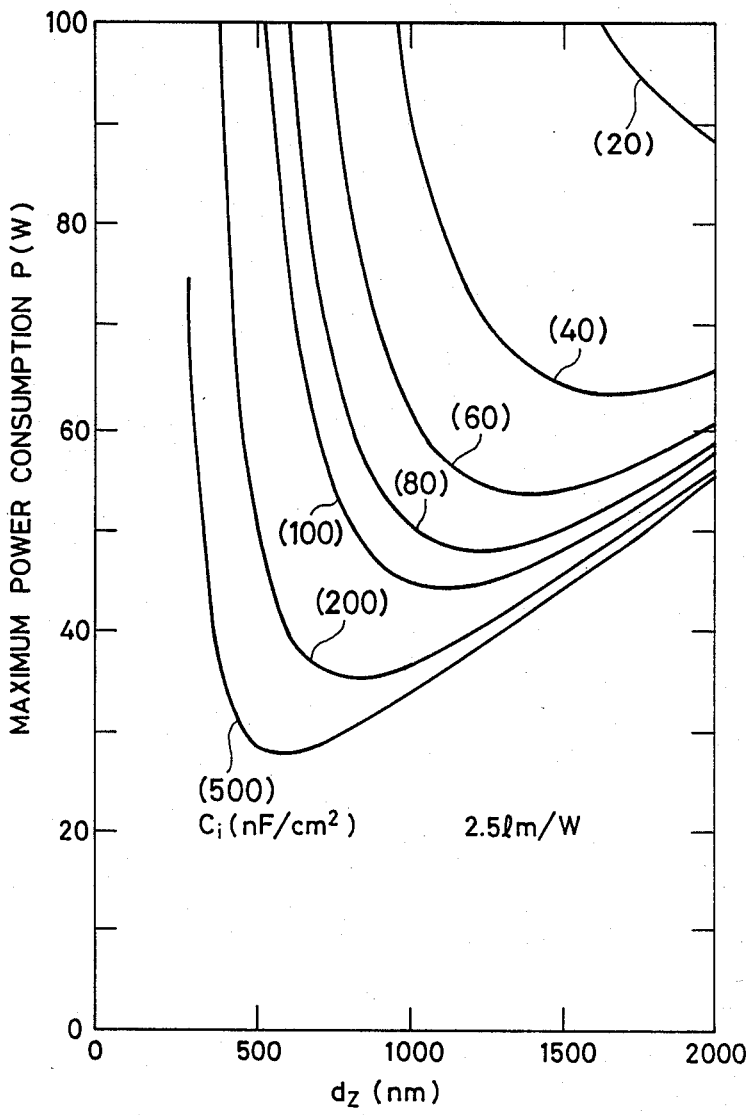
Figure 5D:
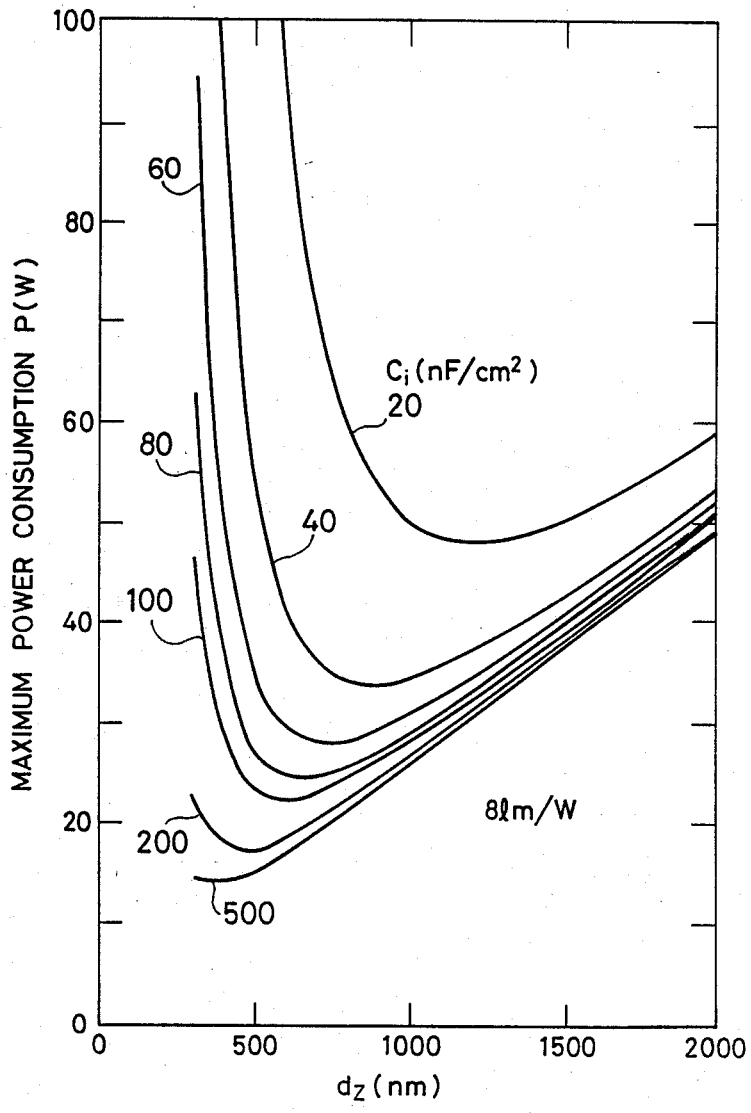
Figure 5E:
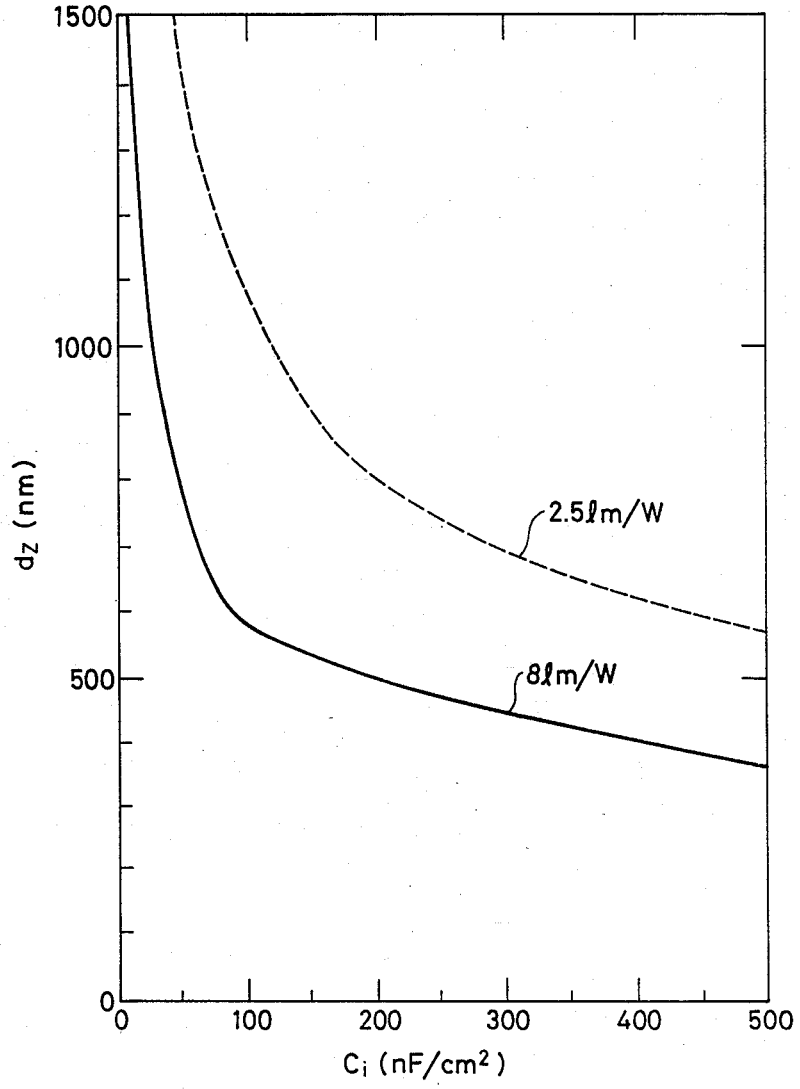

In the above, $L_o$, and $\Delta Q_o$ are values which are established from measured values of the $L-\Delta Q$ characteristic. FIG. 4 shows an example of the $L-\Delta Q$ characteristic. In addition, the light emission efficiency $\eta$ can be expressed by the following equation:

$$\eta=\pi L/(2\Delta Q\cdot E_H\cdot d_z\cdot F) \tag{5}$$

The units of equation (5) are lm/W.

Thus, the values of $E_H$ and $\Delta Q$ can be immediately obtained from the values of the thickness $d_z$ of the phosphor layer, the field frequency F, and the desired brightness L.

The respective values of the variables $\Delta V$, $C_T$, $V_H$, and $V_R$, which are required in order to compute the power consumption $P_M$ of an EL display panel by using equation (1) above, are respectively expressed as follows:

$$\Delta V=\Delta Q/C_i \tag{6}$$

$$C_T=(C_i^{-1}+C_z^{-1})^{-1} \tag{7}$$

$$V_H=E_H\cdot d_z\cdot C_z\cdot(C_i^{-1}+C_z^{-1})=Q_H/C_T \tag{8}$$

$$V_R=\Delta V+V_H \tag{9}$$

$$P_M=F\cdot A\,[2N\cdot\Delta Q^2\cdot C_i^{-2}(C_i^{-1}+C_z^{-1})^{-1}+Q_H^2(C_i^{-1}+C_z^{-1})+(\Delta Q(C_i^{-1}+C_z^{-1})^{-1}+Q_H\cdot C_i)^2C_i^{-2}(C_i^{-1}+C_z^{-1})]+F\cdot N(M+N-1)\,C_o\cdot Q_H^2(C_i^{-1}+C_z^{-1})^2 \tag{10}$$

The time T which is required to charge each display element to x % of the amount of charge that is necessary to initiate light emission is expressed as follows:

$$T=-R\cdot B[C_i\cdot l_n(1-\times/100)n+C_T\cdot l_n(\Delta V/(\Delta V+V_H)] \tag{11}$$

In the above, R is a total value of resistance which is connected in series when a drive voltage is applied to a display element having a photo-emissive element area B, and is a combination of the ON resistance of the drive transistor, electrode resistance, etc. Furthermore if the amount of current which can be supplied by the drive transistor is limited, then an additional time quantity representing (amount of charge)/(limited current) must be added to equation (11), From the aspect of ensuring even distribution of light emission, the charging time T must be smaller than a pulse width $(F \cdot N)^{-1}$ which is determined by the field frequency F and the number of scanning lines N of the EL display panel.

As shown in FIG. 5(*a*), the charging time T that is computed from equation (11) is substantially proportional to the value of $C_i$, assuming that both R and x % are constant, and does not significantly depend upon $d_z$.

Figure 6:
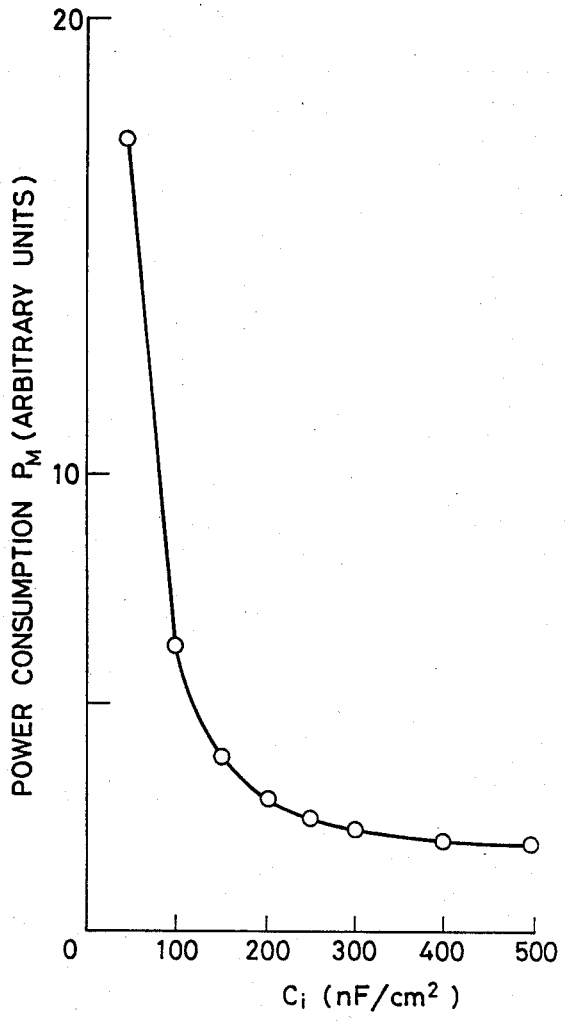
FIG. 6 is a graph showing the relationship between the capacitance $C_i$ of a dielectric layer and power consumption $P_M$.

On the other hand, as shown in FIG. 6, the value of $P_M$ varies in inverse proportion to $C_i^2$. Thus, it is necessary to make the value of $C_i$ large in order to reduce $P_M$. Furthermore if $C_i$ is fixed at a specific value, then the value of $P_M$ becomes a function of $d_z$, and reaches a minimum at a certain value of $d_z$. FIG. 5(*b*) shows the relationship between $P_M$, $d_z$ and $C_i$.

It can thus be understood from the above that with the present invention, a charging time T is determined based upon a pulse width which is utilized in driving the EL display panel, and an upper limit value for $C_i$, which can be designated as $C_{io}$ is thereby established. Next, the value of $d_z$ is established such as to minimize the power consumption $P_M$, using this value $C_{io}$, and hence the optimum configuration for the dielectric layer and the phosphor layer can be determined.

In the embodiment described above, the drive method utilized is in accordance with a drive equation which will be referred to in the following as drive equation [1], and which has been described by Kanaya et al. Another possible drive equation, referred to in the following as drive equation [2] has been proposed by Kurahashi (Keizo Kurahashi, Kazuhiro Takahara, published in an Institute of Television Technology technical report, dated 22nd Dec. 1981). A further drive equation, referred to in the following as drive equation [3], has been proposed by Ohba et al (Toshihiro Ohba, Shigeyuki Harada, Yoshihide Fujioka, Kanaya Yoshiharu and Kamide Hisashi, published in an Institute of Television Technology technical report dated 26th Feb. 1985). The requisite drive power P resulting from each of these drive equations can be collectively approximated by the following equation:

$$P = F \cdot A[K_1 \cdot C_T \Delta V^2 + K_2 \cdot C_T V_H^2 + K_3 \cdot C_i \Delta V \cdot V_H + K_4 \cdot C_T V \cdot V_H] \quad (12)$$

Table 1 below summarizes the relationships between the drive equations mentioned above and the values of $K_1$, $K_2$, $K_3$ and $K_4$.

It can be easily confirmed that the power consumption P obtained from equation (12) can be expressed as a function of $E_H$, $\Delta Q$, $C_z$ and $C_i$, as shown hereinabove.

TABLE 1

| Drive equation | $K_1$ | $K_2$ | $K_3$ | $K_4$ |
|---|---|---|---|---|
| [1] | 2N[1 − (m/M)] + 1 | 2 | 4m/M | 2 − (6m/M) |
| [2] | N | 1 + (m/M) | 2m/M | −2m/M |
| [3] | 4(m/M)[1 − (m/M)](N − 1) | 2 | 4m/M | −2[1 + (m/M)] |

In the above, m denotes the number of selected (light-emitting) data lines, and N, M respectively denote the number of scanning lines and number of data lines.

Figure 7:
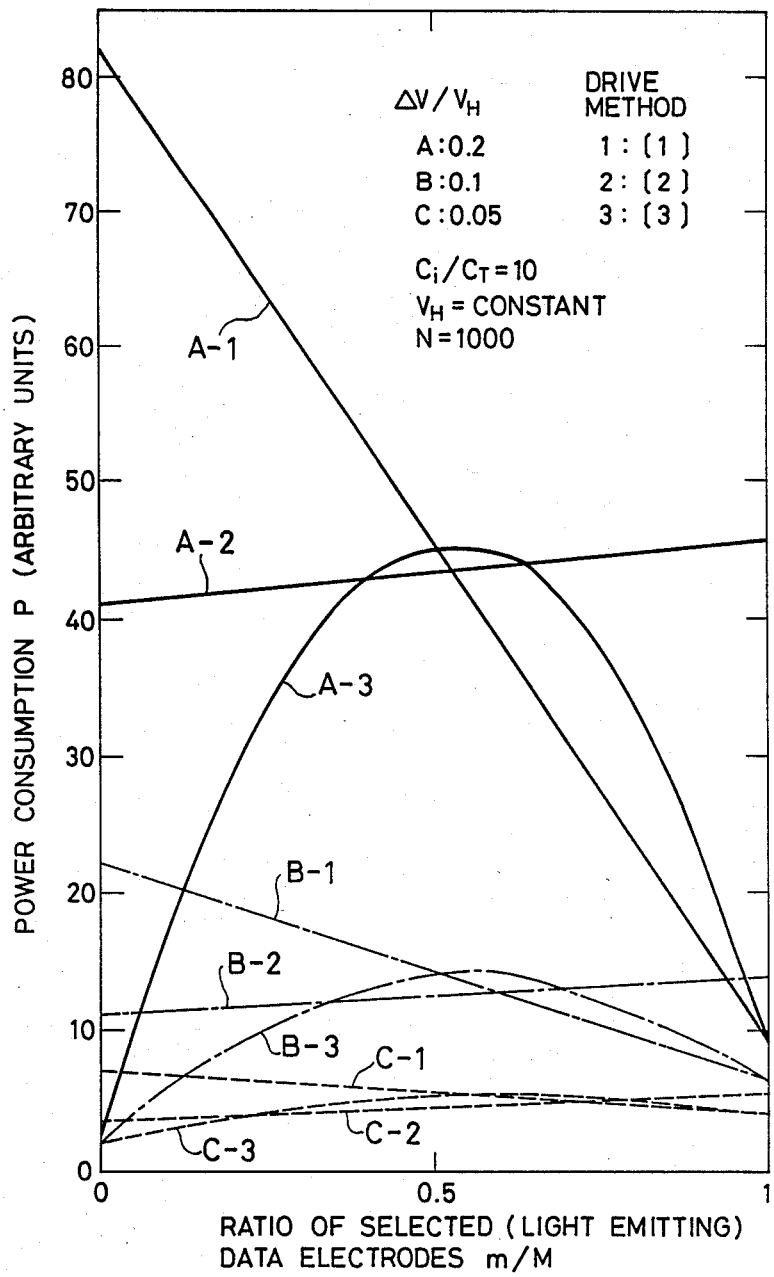
FIG. 7 is a graph showing the relationship between a number of data lines (selected for emission of light) and power consumption P.

FIG. 7 shows the results obtained from computing the power consumption P of an EL display panel from equation (12) using $\Delta V$ and $V_H$ as parameters, for each of the drive equations mentioned above. It is found that of the three drive equations, equation [3] provides the lowest level of power consumption P for an EL display panel if $\Delta V$ is large.

The most effective method of reducing the value of P is to reduce $\Delta V$. As can be understood from equation (6), $\Delta V$ can be decreased by reducing $\Delta Q$ or by increasing $C_i$. From the aspect of construction of the EL display elements, a reduction of $\Delta Q$ can be approached on the basis of increasing the light emission efficiency as shown by equation (5), or by increasing the thickness $d_z$ of the phosphor layer. Increasing the value of the light emission efficiency $\eta$ depends essentially upon the EL elements, and it is difficult to control the value of 72 . Control of the value of $d_z$, on the other hand, is comparatively easy. Furthermore, as can be understood from equation (11) above, any increase in the value of $C_i$ is constrained by the limiting value of charging time. FIGS. 5(*c*) and 5(*d*) show the dependency of the maximum power consumption upon $C_i$ and $d_z$ (obtained using equation (3), when $\eta = 2.5$ and 8 lm/W. These results confirm that a value of $d_z$ can be selected which will provide a minimum level of power consumption, using a value of $C_i$ which is determined by the limiting value of the charging time. FIG. 5(*e*) shows optimum combinations of values of $C_i$ and $d_z$. Based on these results, Tables 2 and 3 show suitable values for configuring an EL display panel. As shown in Table 3 the maximum power consumption of a display panel (designated as panel A) is 46 W, for the case of $\eta$ being equal to 2.5 lm/W, while (panel B) the power consumption is 23 W when $\eta = 8$ lm/W. Hence, a substantial reduction can be attained, by comparison with the prior art example (Example 1 in Table 3), which consumes 140 W. The power consumption values were measured by multiplying the voltages $\Delta V$ and $V_H$ by the respective values of current $\Delta I$ and $I_H$ which flow from the power source when these voltages are applied, adding together the products $(\Delta V \cdot \Delta I)$ and $(V_H \cdot I_H)$ thus obtained, and adding the result to the output power from the power source which is supplied to the drive circuit of the display, to thereby obtain the total power consumption.

TABLE 2

| Basic Specifications of EL Display Panel | | | |
|---|---|---|---|
| No. of scanning lines N | 1,000 | Scanning line pitch | 0.4 mm |
| No. of data lines M | 1,000 | Data line pitch | 0.4 mm |
| Scanning line width | 0.3 mm | Field frequency. F | 60 Hz |
| Data line width | 0.3 mm | Picture element brightness | 100 nit |

TABLE 3

| | EL Element Film Configuration | | Power P(W) |
|---|---|---|---|
| Prior Art Example 1 | $\eta$ = 8 1 m/W, $d_z$ = 500 nm (ZnS:Mn)<br>$C_i$ = 17.7 nF/cm$^2$ | Specific Inductive Capacity $\epsilon_r = 8$ | 140 |

TABLE 3-continued

| | | EL Element Film Configuration | | Power P(W) |
|---|---|---|---|---|
| | | Second dielectric layer is Si—N composite film | Film thickness d = 200 nm | |
| | | First dielectric layer is Si—N composite film | $\epsilon_r = 8$; Film thickness d = 200 nm | |
| Present Invention | A | $\eta = 2.5$ 1 m/W, $d_z = 1100$ nm (ZnS:Mn) $C_i = 90$ nF/cm$^2$ | | 46 |
| | | Second dielectric layer is $BaTa_2O_6$ film | $\epsilon_r = 22$; Film thickness d = 150 nm | |
| | | First dielectric layer is $SrTiO_3$ film | $\epsilon_r = 140$; Film thickness d = 420 nm | |
| | B | $\eta = 8$ 1 m/W, $d_z = 600$ nm (ZnS:Mn) $C_i = 90$ nF/cm$^2$ | | 23 |
| | | Second dielectric layer is $BaTa_2O_6$ film | $\epsilon_r = 22$; d = 150 nm | |
| | | First dielectric layer is $SrTiO_3$ film | $\epsilon_r = 140$; d = 420 nm | |

In each of the EL devices of Table 3, the data electrodes are formed of ITO, and the scanning electrodes of aluminum.

The values of the parameters utilized with the present invention are obtained from the light emission characteristic and electrical characteristic of the EL display panel.

Figure 8:
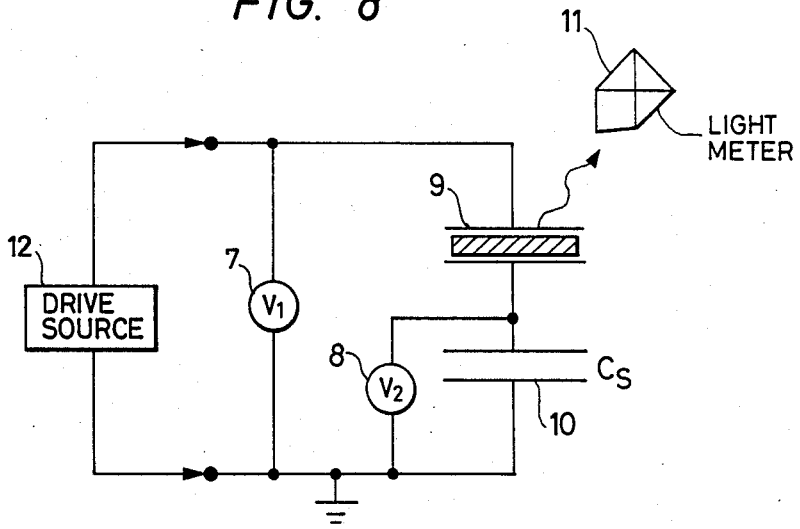
FIG. 8 is a circuit diagram of a system for measurement of a light emission characteristic and electrical characteristic of a thin film EL display panel.

A description will be given in the following of a method of determining the threshold electric field strength $E_H$ for light emission, the film thickness $d_z$ and the dielectric constant $\epsilon_z$ of the phosphor layer of an EL element, and the electrical capacitance $C_i$ of the dielectric layer. FIG. 8 shows a circuit for measurement of the light emission characteristic and electrical characteristic of a thin film EL element. A Sawyer-Tower circuit is used to measure the electrical characteristic, with a capacitor 10 having been selected which has a value of capacitance $C_s$ that is 100 times or more greater than the capacitance of the thin film EL element 9. In FIG. 8, 7 and 8 denote voltmeters whose respective values of measured voltage will be designated in the following as $V_1$ and $V_2$, 11 a brightness meter, and 12 a power source. The following relationship can be established between the electrical capacitance $AC_T$ of the thin film EL element 9 having a display area A, value of capacitance $C_s$, and voltages $V_1$ and $V_2$ applied as shown in FIG. 8:

$$(V_1-V_2)AC_T=V_2\cdot C_s \quad (14)$$

If $C_s >> AC_T$, then $V_1 >> V_2$, so that the above equation can be written as:

$$V_1\cdot AC_T=V_2\cdot C_s \quad (15)$$

Figure 9:
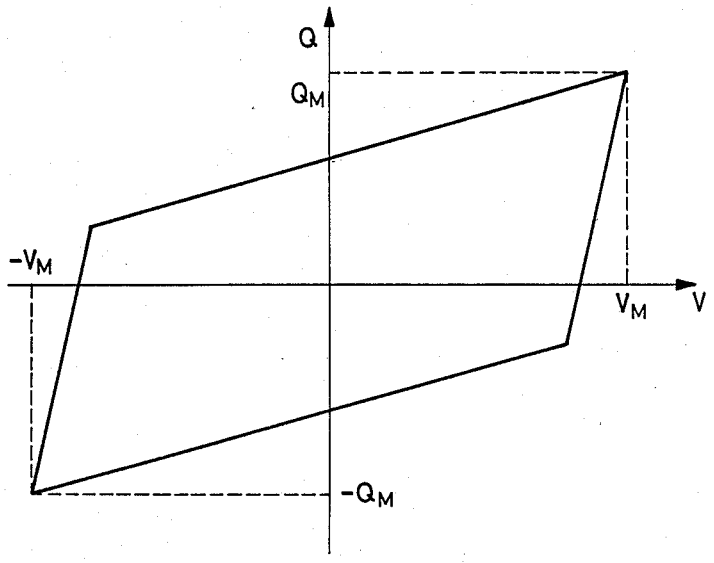
FIG. 9 shows a hysteresis loop exhibited by a phosphor layer.

In this case, the voltage which is applied to the thin film EL element becomes equal to $V_1$, and the total load capacitance AQ which must be charged is equal to $(V_2\cdot C_s)$. FIG. 2(*b*) shows the usual relationship between the charge density Q and the applied voltage V of a thin film EL display panel. As shown, during the non-light emissive condition, the phosphor layer can be considered as a capacitor, while during light emission, the phosphor layer becomes electrically conducting, due to the avalanche condition so that as shown in FIG. 9 a hysteresis loop is exhibited.

Figure 1:
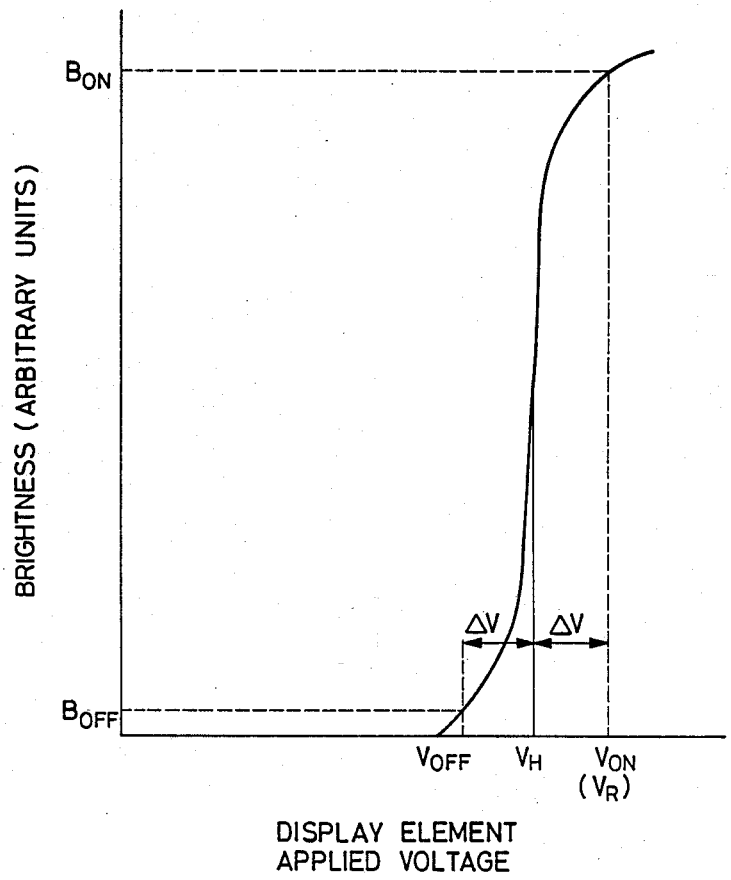
FIG. 1 is a graph showing the relationship between the voltage applied to a display element of an EL display panel and the emitted light intensity.
Figure 10:
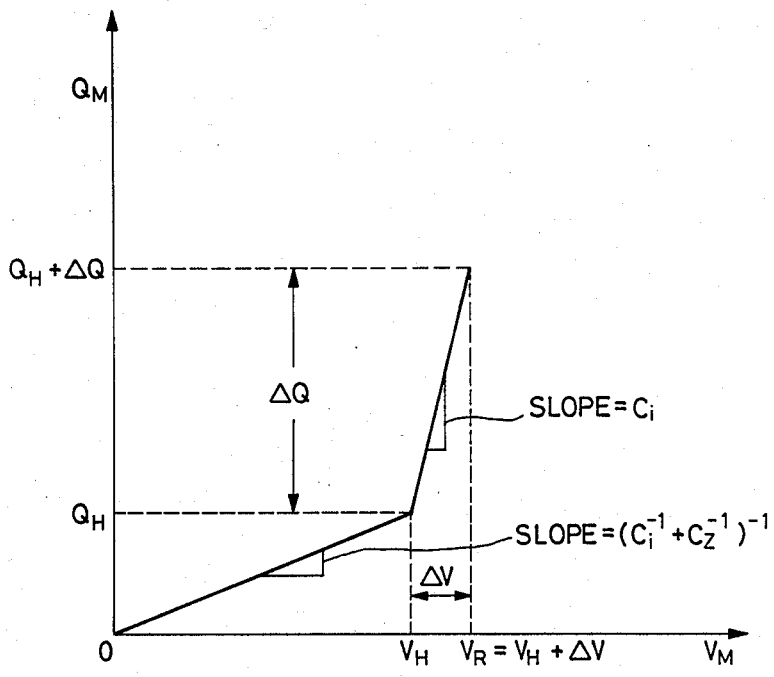
FIG. 10 is a graph showing the relationship between applied voltage and charge density.

FIG. 10 shows the results of plotting the peak values $Q_M$ and $V_M$ of the charge density Q and applied voltage V, with respect to the applied voltage. The point of inflection of the characteristic shown in FIG. 10 occurs at the voltage $V_H$, and as shown in FIG. 1, no emission of light occurs at values of voltage which are lower than $V_H$, while light emission occurs for values higher than $V_H$. At the inflection point shown in FIG. 10, the voltage is $V_H$ and the electrical charge per unit area is $Q_H$. The slope of the characteristic, for voltages lower than $V_H$, is $(C_i^{-1}+C_z^{-1})^{-1}$, and is equal to $C_i$ for values of voltage higher than $V_H$. In this way, the values of $C_i$, $C_T$, $V_H$ and $Q_H$ for equations (6), (7) and (8) can be determined.

N and M in equation (10) respectively denote the number of scanning lines and number of data lines of the EL display panel. The stray capacitance $C_o$ of the drive system can be obtained by measurement, using for example an impedance meter. With regard to measurement of $\Delta V$ and $V_R$, if the voltage dependency of the display brightness is measured to obtain a characteristic as shown in FIG. 1, then the voltage which provides a desired level of brightness is the requisite value of $V_R\cdot\Delta V$ is given as $(V_R-V_H)$. The charging time T can be obtained from the results of measurement of the overshoot response characteristic of the current which actually flows in the scanning lines or data lines, e.g. by using an oscilloscope. A simple method of measuring the drive power of an EL display panel is to approximate the value of the power as the product of the voltage and current supplied from the drive power source. This provides a good approximation to actual measured values of drive power.

By utilizing the present invention to design an EL display panel, an optimum configuration for the elements of the apparatus can be obtained with respect to minimizing power consumption while providing a high level of display brightness, enabling a large-scale high-definition EL display panel to be produced.

What is claimed is:

1. An electroluminescent display panel comprising a phosphor layer having a predetermined thickness $d_z$ and a dielectric layer formed on at least one side of said phosphor layer and having a value of electrical capacitance $C_i$ per predetermined unit of area which is greater than a value of electrical capacitance $C_z$ per said unit of area of said phosphor layer, and two arrays of mutually intersecting stripe-configuration electrodes formed sandwiching said phosphor layer and dielectric layer for defining an array of display elements and for applying a drive voltage to said display elements, each of said display elements having a fixed value of light emission efficiency $\eta$, at least one of said electrode arrays being transparent to light, the display panel being characterized in that, expressing a time T which is required to supply an amount of electric charge to each of said display elements, such as to produce a desired level of brightness of light emission from each said display element, as a function $T(d_z, C_i, R, \eta)$ of said thickness $d_z$, said capacitance $C_i$, an impedance R constituted by values of resistance of said electrodes and of a drive circuit system coupled to drive said display panel, and said light emission efficiency $\eta$, the value of said capacitance $C_i$ is selected as a value $C_{io}$ which results in minimum allowable value for said time T, and in that, expressing a value of power consumption P of said display panel as a function $P(d_z, C_i, \eta)$ of said thickness $d_z$, said fixed value of light emission efficiency $\eta$ and said capacitance $C_i$, the value of $d_z$ is selected to produce a minimum value of said power consumption P with said capacitance $C_i$ fixed at said value $C_{io}$.

2. An electroluminescent display panel according to claim 1, in which said minimum allowable value of said time T is made less than the inverse $(F \cdot N)^{-1}$ of the product of a field frequency F and a number of scanning lines N of said electroluminescent display panel.

* * * * *